United States Patent [19]

Palz

[11] Patent Number: 4,492,568

[45] Date of Patent: Jan. 8, 1985

[54] PROCESS AND APPARATUS FOR PREHEATING THE COMBUSTION MEDIUMS USED FOR FIRING BLAST FURNACE STOVES

[75] Inventor: Helmut Palz, Wiesbaden, Fed. Rep. of Germany

[73] Assignee: Didier-Werke AG, Wiesbaden, Fed. Rep. of Germany

[21] Appl. No.: 559,683

[22] Filed: Dec. 9, 1983

[30] Foreign Application Priority Data

Dec. 14, 1982 [DE] Fed. Rep. of Germany ..... 3246255
Dec. 30, 1982 [DE] Fed. Rep. of Germany ..... 3248623

[51] Int. Cl.[3] ..... F24H 7/00; F24H 1/00; F28C 3/10; C21C 5/48

[52] U.S. Cl. ..... 432/30; 266/139; 432/219

[58] Field of Search ..... 432/28, 29, 30, 214, 432/216, 219; 266/139

[56] References Cited

U.S. PATENT DOCUMENTS 4,452,586 6/1984 Voges ..... 432/30

*Primary Examiner*—John J. Camby
*Attorney, Agent, or Firm*—Wenderoth, Lind & Ponack

[57] ABSTRACT

Combustion air and fuel gas used for firing blast furnace stoves is preheated by utilizing the heat of waste gases resulting from such firing. The combustion air and fuel gas are passed through respective heat exchangers in heat exchange relationship with the waste gases, thereby preheating the combustion air and fuel gas. The combustion air, after passage thereof through the respective heat exchanger, is further preheated by an externally fired recuperator. The flue gases from the externally fired recuperator are fed to the waste gases before preheating of the combustion air by such waste gases. The external firing of the recuperator is controlled as a function of the final preheated temperature of the thus twice preheated combustion air.

17 Claims, 2 Drawing Figures

PROCESS AND APPARATUS FOR PREHEATING THE COMBUSTION MEDIUMS USED FOR FIRING BLAST FURNACE STOVES

BACKGROUND OF THE INVENTION

The present invention relates to a process and apparatus for preheating combustion mediums, for example combustion air and fuel gas. More specifically, the present invention relates to such a process and apparatus for preheating such combustion mediums used for firing blast furnace stoves by utilizing the heat of waste gases resulting from such firing.

The overall efficiency of a blast furnace stove is heavily dependent upon the thermal use of the waste, flue or exhaust gases produced during firing of the blast furnace stoves and coming from the checker work or checker shafts at a temperature which is still relatively high, if the size of the blast furnace stove is to be maintained within practical limits. Accordingly, the heat content of the waste gases resulting from the firing of the blast furnace stoves is utilized, for example in heat exchangers for preheating fuel gas and the combustion air employed for heating or firing of the blast furnace stoves. A problem with such arrangement is that the waste gases, after passing through the heat exchangers, are at a temperature below the dew point temperature. This may result in corrosion of the waste gas lines, in the waste heat flue, in the stack and in the colder heat exchange components, thus leading to premature failure of one or more of such elements. If extreme temperature fluctuations of the waste gases emerging from the blast furnace stoves continue to occur, it is necessary to maintain the waste gas temperature on the entry side of the stack relatively constant in order to save energy and also to prevent the dew point from dropping below a predetermined value.

SUMMARY OF THE INVENTION

With the above discussion in mind, it is the object of the present invention to provide a novel process and apparatus for preheating combustion mediums in a manner to avoid the above and other prior art disadvantages.

It is a more specific object of the present invention to provide such a process and apparatus for preheating the combustion mediums used for firing blast furnace stoves while avoiding the above disadvantages in a technically simple manner by improving the utilization of the heat of the waste gases at relatively high hot blast temperatures and thereby operating the blast furnace stoves with optimum economy.

The above objects are achieved in accordance with one aspect of the present invention by the provision of a process for preheating the combustion mediums of combustion air and fuel gas used for firing blast furnace stoves by utilizing the heat of waste gases resulting from such firing, by passing the combustion mediums through respective heat exchangers in heat exchange relationship with the waste gases, and thereby preheating the combustion mediums. At least one combustion medium, after the passage thereof through the respective heat exchanger is further preheated by an externally fired recuperator. Flue gases from the externally fired recuperator are fed to the waste gases before preheating of the one combustion medium by the waste gases. The external firing operation of the recuperator is controlled as a function of the final preheated temperature of the thus twice preheated one combustion medium. Preferably the one combustion medium comprises the combustion air. Further preferably, the waste gases first preheat the combustion air, then preheat the fuel gas and then pass to a stack.

In accordance with another aspect of the present invention, there is provided an apparatus for preheating the combustion mediums of combustion air and fuel gas used for firing blast furnace stoves by utilizing the heat of waste gases resulting from such firing. A waste gas main conveys waste gases resulting from firing of blast furnace stoves. First and second heat exchangers are arranged serially along the waste gas main for passing the combustion mediums in heat exchange relationship with the waste gases, and thereby preheating the combustion mediums. An externally fired recuperator is provided, and one combustion medium, after the passage thereof through the respective heat exchanger, is passed in heat exchange relationship with the flue gases of the recuperator, thereby further preheating the one combustion medium. Means is provided for feeding the flue gases of the recuperator, after the further preheating of the one combustion medium thereby, to the waste gas main at a position upstream of the heat exchanger for the one combustion medium. A first temperature sensor and control detects the final preheated temperature of the thus twice preheated one combustion medium and operates to control the external firing of the recuperator as a function of such detected temperature. The first and second heat exchangers operate to preheat the combustion air and fuel gas, respectively. The one combustion medium preferably comprises combustion air. A stack is connected to the waste gas main downstream of the second heat exchanger.

By the above arrangement of feeding the flue gases from the externally fired recuperator to the waste gases upstream of the first heat exchanger, there results a double heat exchange with feedback, with the result that the flue gas temperature and the flue gas volume from the recuperator participate to a large extent in the heat exchange relationship which occurs in the first heat exchanger. The recuperator need supply only the quantity of heat for the one medium, i.e. the combustion air, to be preheated and which is necessary to achieve the desired final temperature of such medium. The heat exchanger of the combustion air, which heat exchanger is supplied both with the waste gases from the firing of the blast furnace stoves and with the flue gases from the recuperator, is to provide the larger quantity of heat to the one medium to be preheated.

However, the relative quantities of the one combustion medium, i.e. combustion air, which are preheated by the respective first heat exchanger and/or by the recuperator may be apportioned, and this apportionment may be controlled as a function of the temperature of the waste gases at the entrance to the stack.

If the waste gases emerging from the blast furnace stoves are subjected to extreme temperatures, it is necessary to maintain the temperature of the waste gases at the entrance to the stack as constant as possible in order to save energy. For example, if the waste gas temperature from the blast furnace stoves is low, then only a small amount of combustion air, or none at all, is passed through the first heat exchanger. Thus, only a small quantity of heat, or none at all, is drawn from the waste gases. In this case, the externally fired recuperator transfers most or all of the heat needed for the preheating of the fuel gas. That is, the flue gases from the recuperator pass into the waste gas line and thereafter achieve preheating of the fuel gas at the second heat exchanger. The heat from the flue gases of the externally fired recuperator, together with any heat available from the waste gases from the blast furnace stoves, is used to preheat the fuel gas in the second heat exchanger. This second heat exchanger is dimensioned such that the desired preheating temperature is reached. When the temperature of the waste gases from the blast furnace stoves increases, the waste gas temperature at the entrance to the stack will tend to rise accordingly, but is prevented from doing so, because this temperature, which is to be maintained constant, is used to regulate the quantity of air that passes through the first heat exchanger. Such first heat exchanger is so dimensioned that when the temperature of the waste gases from the blast furnace stoves is at a maximum, the temperature of the waste gases at the entrance of the stack is maintained at a preferably constant predetermined value. The heat in the first heat exchanger represents recovered heat which may be passed to the externally fired recuperator, at which the combustion air continues to be heated until it reaches a desired finally preheated temperature. As more heat is transferred to the combustion air by the waste gases in the first heat exchanger, the final preheated temperature of the combustion air is employed to reduce the amounts of fuel supplied to the external firing of the recuperator, thereby achieving regulation of the final preheating temperature of the combustion air at a constant predetermined temperature. This savings in fuel represents the heat gain of the installation.

With this arrangement, it also is possible to maintain the preheating temperature of the fuel gas in the second heat exchanger as constant as possible. Thus, it is provided that the admission of waste gas heat to the second heat exchanger is controlled in a manner to achieve a substantially constant preheating of the fuel gas and such that the waste gas temperature at the entrance to the stack is maintained substantially constant.

In accordance with the present invention, when a high preheating temperature of the combustion air is required, the quantity of heat provided by the externally fired recuperator also will tend to increase. As a result, the combustion air will receive additional preheating in the first heat exchanger as a result of the increase in heat supplied to the waste gases in the first heat exchanger from the flue gases of the recuperator. As a result, it will be possible to turn down the burners of the recuperator to reduce the heat production therefrom. This turning up and down is achieved automatically as a function of the final preheated combustion air temperature by the first temperature sensor control means until the interconnected units, i.e. the first heat exchanger and the externally fired recuperator, have reached thermal equilibrium conditions dependent upon the desired final preheated temperature of the combustion air.

In order to comply with the operating conditions of blast furnace stoves in which the temperature of the waste gases change periodically between minimum and maximum values and in which fluctuations also may occur in the quantity of the available waste gases due to operational changes, there is provided an arrangement of a second temperature sensor control means for detecting the temperature of the flue gases entering the recuperator, and a return circuit controllable by the second temperature sensor control means for supplying to the recuperator waste gases from the waste gas main at a position downstream of the second heat exchanger, thereby controlling the temperature in the recuperator. Specifically, there is provided a mixing chamber receiving the flue gases from the external firing operation, a branch line extending from the waste gas main at a position downstream of the second heat exchanger to the mixing chamber, and a blower operable in response to the temperature detected by the second temperature sensor to withdraw waste gas from the waste gas main through the branch line to the mixing chamber.

Furthermore, there may be provided an additional waste gas return circuit for returning waste gases from the waste gas main at a position between the first and second heat exchangers to the waste gas main at a location upstream of the first heat exchanger. This return circuit may be operated by a third temperature sensor control means for detecting the temperature of the waste gases at the entrance to the stack to thereby regulate the temperature of the waste gases at the entrance to the stack. This return circuit further may be monitored by a fourth temperature sensor control means for detecting the temperature of the preheated fuel gas and thereby to regulate the fuel gas preheating temperature.

By means of these waste gas return circuits, the quantities of heat within the apparatus can be lowered such that it is possible to achieve constant predetermined preheating temperatures of the combustion mediums and also to achieve an optimum waste gas discharge temperature at the entrance of the stack, even during the occurrence of operation induced volume and temperature changes with regard to the waste gases emerging from the blast furnace stoves. In accordance with the present invention, it is contemplated that the control of the feedback of the externally fired recuperator and the control of the operation of the waste gas return circuits be achieved by known control systems which are capable of achieving the controls functionally described herein in response to detected temperatures.

In accordance with a further feature of the present invention, the waste gas return circuit from between the two heat exchangers to the entrance of the first heat exchanger may be replaced by a waste gas return circuit extending from between the two heat exchangers to the branch line leading from the downstream side of the second heat exchanger to the entrance to the recuperator. Such branch line and this return circuit line each may be provided with throttle valves, and these throttle valves may be operated in response to a detected temperature of the waste gases at the entrance to the stack and monitored by a detected preheated fuel gas temperature.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
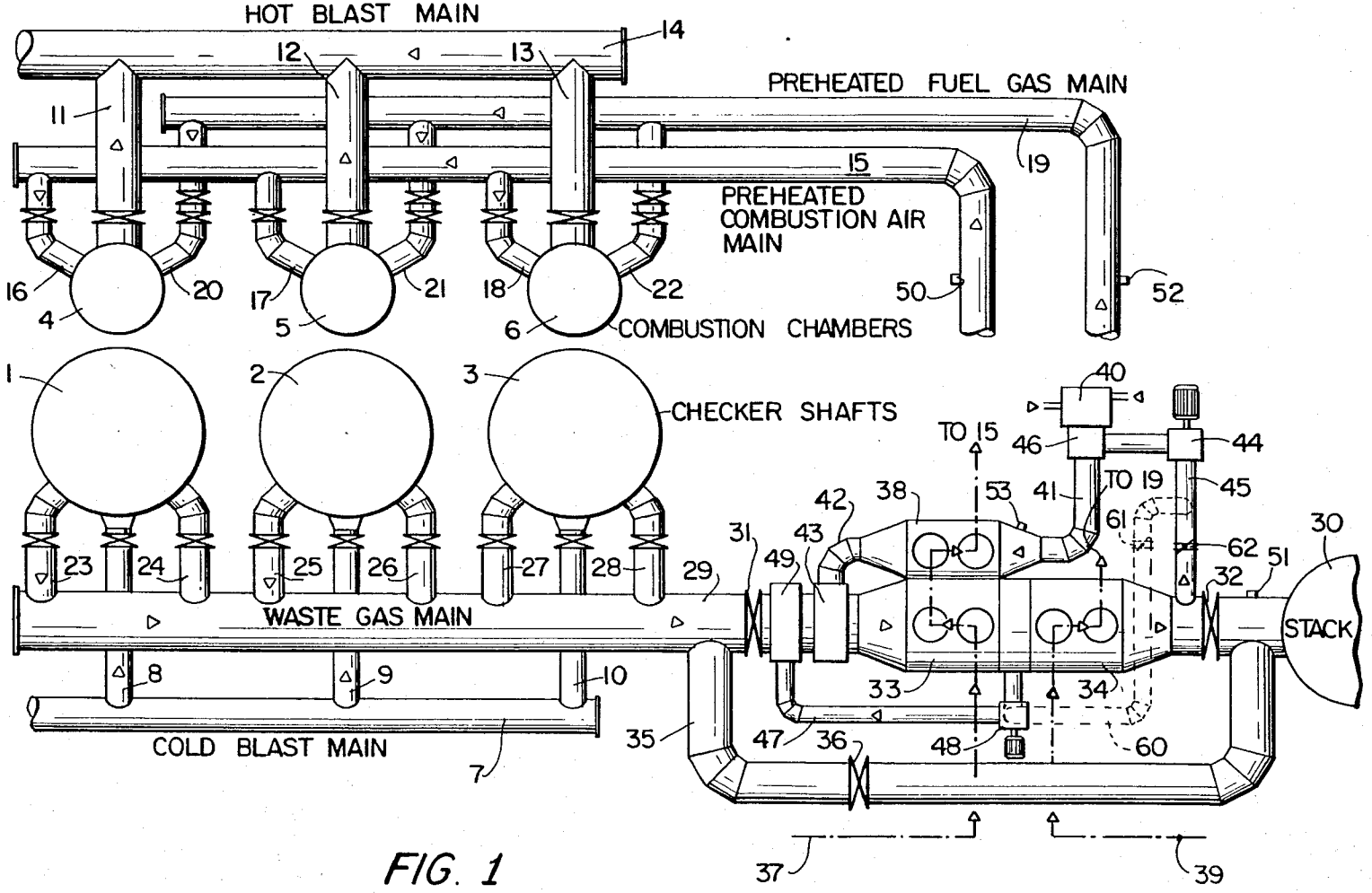
FIG. 1 is a schematic view of a first embodiment of the present invention.

Shown in the drawings are checker shafts or chambers 1, 2, 3 of blast furnace stoves having outer combustion shafts or chambers 4, 5, 6, respectively. Blast furnace stove 1, 4 or 2, 5 or 3, 6 are periodically fired and cold blasted so as to produce a hot blast, with a cold blast from a cold blast line or main 7 entering checker shafts 1, 2, 3 via branch lines 8, 9, 10 and issuing from the stoves as hot blasts via connecting lines 11, 12, 13 into hot blast line or main 14 which is connected to a blast furnace (not shown). During periods of firing, preheated combustion mediums are passed to combustion shafts 4, 5, 6. Specifically, preheated combustion air is supplied from line or main 15 via branch lines 16, 17, 18, and preheated fuel gas is supplied from line or main 19 via branch lines 20, 21, 22. The waste gases of the fired blast furnace stoves issue from checker shafts 1, 2, 3 via waste gas connecting lines 23, 24 or 25, 26 or 27, 28 into waste gas line or main 29 and then pass eventually to a stack 30.

Waste gas main 29 has provided between two gate valves 31 and 32 therein first and second serially connected heat exchangers, i.e. a combustion air preheater or heat exchanger 33 and a fuel gas preheater or heat exchanger 34. Also provided is a bypass line 35 arround the heat exchangers 33, 34 and provided with a gate valve 36. Combustion air to be preheated and to be fed to main 15 is supplied from a suitable blower or other source (not shown) as indicated by the dashed line path 37 shown in FIG. 1. The combustion air first flows through first heat exchanger 33 in heat exchange relationship with the waste gases passing therethrough, then passes through recuperator 38 in heat exchange relationship with flue gases passing therethrough, and finally is supplied to main 15 which receives and holds the preheated combustion air in readiness for supply to combustion shafts 4, 5, 6. Fuel gas to be preheated and fed to main 19 is supplied from a suitable source (not shown) and follows the dashed line path 39 shown in FIG. 1, through second heat exchanger 34, in parallel flow or in counter flow, and therein passes in heat exchange relationship with waste gases passing through second heat exchanger 34, and then is fed directly into main 19 for supply to combustion chambers or shafts 4, 5, 6.

Recuperator 38 is fired externally by burners or a burner 40 and flue gases therefrom are supplied to recuperator 38 via line 41. Burner 40 preferably is operated with low quality fuel gases. The flue gases from burner 40, recuperator 38 are discharged through a line 42 and are fed into waste gas main 29 via a mixing chamber 43 at a position upstream of first heat exchanger 33, whereby the combustion air is preheated at first exchanger 33 not only by the waste gases from main 29, but also by the flue gases from the recuperator 38.

A waste gas return circuit formed of branch line 45, blower 44 and mixing chamber 46 makes it possible to draw off, downstream of second heat exchanger 34, waste gases from waste gas main 29 and to mix them with hot flue gases from burner 40, such mixed gases then passing through recuperator 38.

FIG. 1 shows another waste gas return circuit including blower 48, line 47 and mixing chamber 49 whereby it is possible to draw off waste gases from main 29 at a position between first and second heat exchangers 33, 34 and to introduce such withdrawn waste gases at a position upstream of the first heat exchanger 33.

FIG. 1 illustrates another waste gas return circuit 60 in dashed lines, circuit 60 being intended to replace circuit 48, 47, 49. Circuit 60 also draws off waste gases from main 29 at a position between heat exchangers 33, 34 and introduces such waste gases into branch line 45. Return circuit 60 and branch line 45 are provided with respective throttle valves 61, 62.

The operation of return circuit 48, 47, 49 or the operation of valves 61, 62 are controlled by temperature sensors 51, 52, to be discussed in more detail below.

The operation of the apparatus illustrated in FIG. 1 now will be described. Initially, it is pointed out that the size of a heat exchanger provided in the waste gas line of a blast furnace stove determines for a given performance of the stove the waste gas temperature at the discharge side of the heat exchanger. If the heating of only one combustion medium is envisioned, the preheater is so dimensioned that an optimally low temperature is established at the entrance to the stack. If a second combustion medium is to be preheated, a second heat exchanger is provided in the waste gas main at a location downstream of the first heat exchanger, the overall dimensions being such that the desired preheating temperatures of the two combustion mediums, as well as an optimally low temperature at the entrance side of the stack are achieved. If the heat requirements to achieve satisfactory preheating of the two combustion mediums are higher than the capacity of the heat supplied by the waste gases from the blast furnace stoves, the regenerator 38 will be activated.

Assuming that the waste gases emerging from the firing of the blast furnace stove system have at the start of the firing of a blast furnace stove a temperature of, for example, 250° C., and at the end of the firing operation a temperature of, for example, 350° C., and that the combustion air is to be preheated to a fixed temperature of, for example, 500° C., then the externally fired recuperator 38 will be operated to produce the heat potential which is needed over and above the heat supplied by the waste gas in the first air preheated or heat exchanger 33. A first temperature sensor 50 provided in preheated combustion air main 15 determines the temperature of the combustion air preheated in first heat exchanger 33 and recuperator 38 and supplied to main 15 and provides appropriate signals or pulses for the control of the operation of recuperator burner 40. In other words, the operation of burner 40 is controlled as a function of the temperature detected by sensor 50 to ensure that recuperator 38 provides the amount, and only the amount, of heat not supplied to the combustion air during preheating thereof in first heat exchanger 33, thereby ensuring that the combustiom air is finally preheated up to the predetermined temperature of 500° C.

Externally fired recuperator 38 is arranged in close proximity to heat exchanger 33. This ensures short paths relatively free of heat loss for the combustion air from heat exchanger 33 to recuperator 38 and also for the flue gases passing from recuperator 38 into waste gas main 29 via line 42 and mixing chamber 43. Heat exchanger 33 and recuperator 38 with flue gas line 42 and mixer 43 together form a system by which the combustion air passing through heat exchanger 33 and being preheated therein receives a maximum quantity of heat from the waste gas-flue gas mixture before the combustion air passes in heat exchange relationship through recuperator 38. Thereby, recuperator 38 can be of relatively small dimensions since, on the one hand, the heat of the flue gas is utilized together with the heat of the waste gases in heat exchanger 33 to carry out the major portion of preheating of the combustion air and, on the other hand, there is no need for a separate expensive system to achieve fuel economy of the flue gases in recuperator 38.

In accordance with the present invention, there is provided an arrangement for controlling the temperature of the gas supplied to recuperator 38. Thus, the return circuit formed by branch line 45, blower 44 and mixing chamber 46 is operated in response to the detection of the temperature of the flue gases entering recuperator 38 by means of a second temperature sensor 53. Sensor 53 detects the temperature of the gases entering recuperator 38 and operates return circuit 45, 44, 46 as necessary to mix with the flue gases from the burner 40 required amounts of relatively cooler waste gases from main 29 to thereby control the temperature of the gases flowing through recuperator 38.

The second waste gas return circuit 48, 47, 49 influences the operation of fuel gas preheating heat exchanger 34. The operation of circuit 48, 47, 49 is controllable by a third temperature sensor 51 for detecting the temperature of the waste gases in main 29 at the entrance to stack 30. This control similarly and simultaneously may be achieved by a fourth temperature sensor 52 for detecting the temperature of the preheated fuel gas in main 19. Thereby, it is possible by third temperature sensor 51 to operate return circuit 48, 47, 49 to control the temperature of the waste gases at the entrance to stack 30, and also to control this return circuit by fourth temperature sensor 52 to control the temperature of the preheated fuel gas in main 19. Thus, third temperature sensor control 51 may operate to open return circuit 48, 47, 49 as soon as the temperature exceeds a predetermined upper limit, for example 150° C., of a temperature range above the dew point, such range being, for example, from 100° to 150° C., and the waste gases still contain usable heat. Fourth temperature sensor 52 monitors the temperature of the preheated fuel gas in order to prevent it from dropping by a substantial value, for example below 200° C. In principle, the apparatus can be controlled with the aid of preset temperatures for the preheated combustion air, for the preheated fuel gas, and for the waste gases at the entry to the stack by means of conventional control devices, for optimum utilization of the waste gases, while preheating the combustion mediums to relatively high temperatures in order to obtain high blast temperatures.

Variations of the apparatus of course are possible. For example, the preheating of the fuel gas can be eliminated, and the apparatus can be operated solely with a combustion air preheating system comprising a heat exchanger 33 with an externally fired fuel gas recuperator 38, and in a further variation with a simple heat exchanger.

Figure 2:
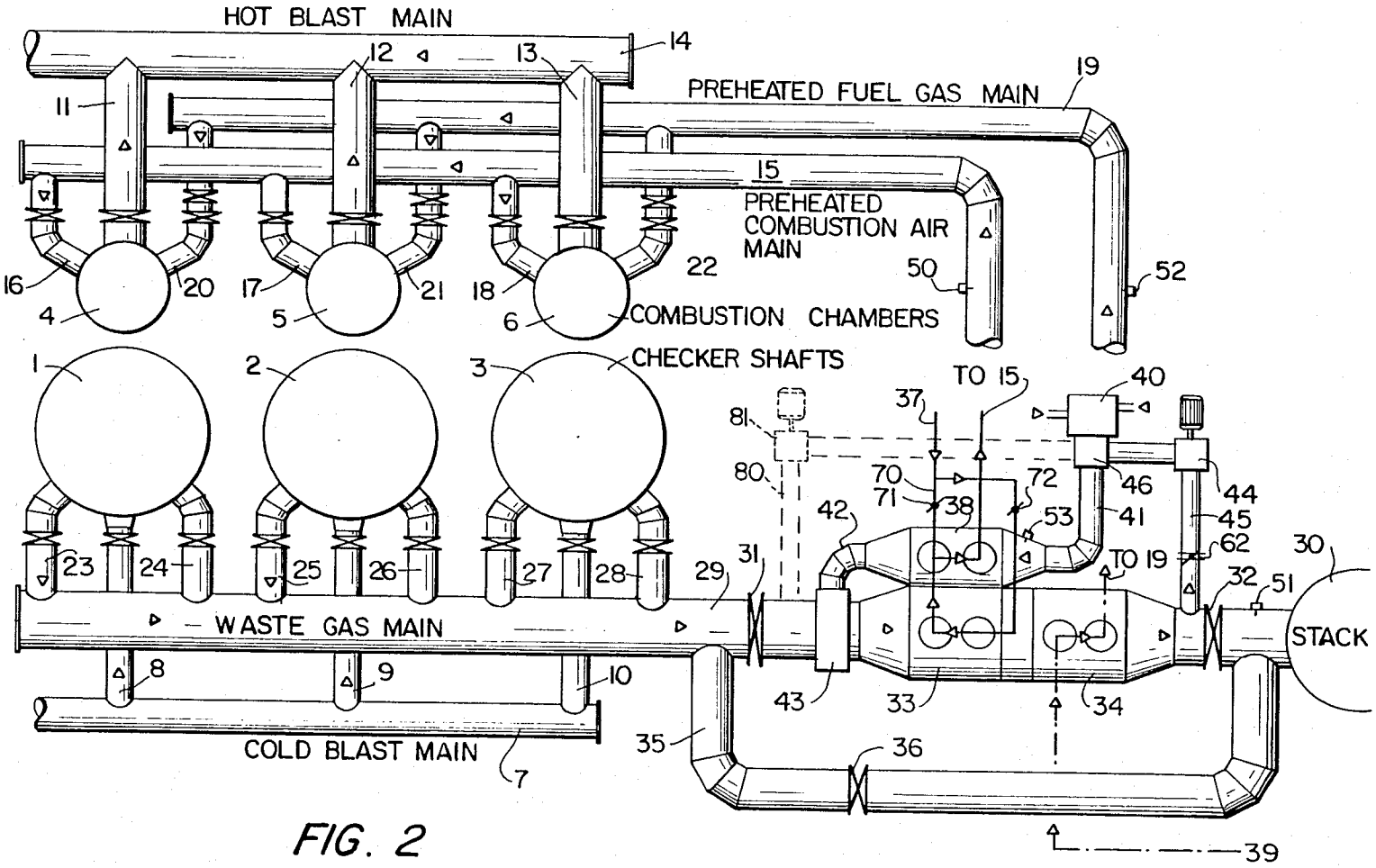
FIG. 2 is a view similar to FIG. 1 but of a further embodiment.

The embodiment of FIG. 2 differs from the embodiment of FIG. 1 in a number of respects. Thus, the embodiment of FIG. 2 does not employ either of the waste gas return circuits 48, 47, 49 or 60. However, the embodiment of FIG. 2 includes a conduit system 70 provided with control valves 71, 72 for apportioning the relative quantities of the combustion air to be preheated by the respective heat exchanger 33 and/or by the recuperator 38. This apportioning is controlled by third temperature sensor control means 51 to achieve regulation of a suitable temperature of the waste gases at the entry to stack 30. Thus, control valves 71, 72 pass the combustion air to be preheated from supply 37 through air preheater or first heat exchanger 33 and/or externally fired regenerator 38, and the finally preheated combustion air then is fed to main 15 which receives the preheated combustion air and holds it in readiness for use in combustion chambers 4, 5, 6.

In the case of extreme variations of the temperature of the waste gases emerging from the blast furnace stove system, it is necessary to pass the combustion air in varying manners through the conduit system 70, in dependence upon the temperature of the waste gases. It is important that the waste gas temperature at the entrance to the stack 30 be kept as constant as possible. If, for example, the temperature of the waste gases from the blast furnace stove system is low, then only a small quantity of combustion air, or none at all, will flow through heat exchanger 33. Control valve 72 will be closed or substantially closed so that all of the combustion air, or substantially all of the combustion air, with control valve 71 open, will pass only through recuperator 38. Thus, only a small quantity of heat, or none at all, will be drawn from the waste gas passing through heat exchanger 33. Externally fired recuperator 38 then provides most or all of the heat required to preheat the combustion air. The heat of the flue gases from externally fired recuperator 38 will be used in combination with any heat from the waste gases from the blast furnace stove system to preheat the fuel gas in the heat exchanger 34. Heat exchanger 34 is dimensioned such that the fuel gas is preheated until it reaches the required temperature and that the heat from the flue gases from recuperator 38, together with any heat from the waste gases of main 29, is sufficiently high to preheat the fuel gas to the desired temperature. As the temperature of the waste gases in main 29 from the blast furnace stove system rises, the waste gas temperature at the entrance to stack 30, detected by sensor 51, also will tend to rise. This temperature however is to be maintained constant, and this is achieved by sensor 51 controlling valves 71, 72 to determine the quantity of combustion air which will be caused to flow through heat exchanger 33. As the waste gas temperature from the blast furnace stove system continues to rise, the quantity of air flowing through the system of heat exchangers also will increase. In an extreme case, control valve 71 will be closed and control valve 72 will be opened, so that the combustion air makes its way to main 15 via open control valve 72 through heat exchanger 33 and recuperator 38. Heat exchanger 33 is so dimensioned that, when the temperature of the waste gas from the blast furnace stoves is at a maximum, the waste gas temperature detected by sensor 51 at the entrance to the stack has a constant fixed value.

FIG. 2 illustrates a further modification involving elimination of the waste gas return circuit 45, 44. In place thereof, a waste gas return circuit is provided to include a branch pipe 80 extending from main 29 to mixer 46 and a blower 81 operable to transfer waste gas from upstream of heat exchanger 31 to mixing changer 46. This waste gas return circuit is indicated in FIG. 2 by dashed lines, and has the advantage that a larger quantity of heat is supplied to mixing chamber 46 when the waste gases from the blast furnace stoves have a high temperature, thereby further reducing the requirement of fuel for firing of burner 40.

Those of ordinary skill in the art readily will understand from the above discussion types of elements which may be employed for temperature sensors 50, 51, 52, 53 and to enable control of the various return circuits in response to temperatures detected thereby.

Although the present invention has been described and illustrated with respect to preferred features thereof, it is to be understood that various modifications may be made to the specifically described and illustrated features without departing from the scope of the present invention.

I claim:

1. A process for preheating the combustion mediums of combustion air and fuel gas used for firing blast furnace stoves by utilizing the heat of waste gases resulting from such firing, said process comprising:

passing said combustion mediums through respective heat exchangers in heat exchange relationship with said waste gases, and thereby preheating said combustion mediums;

further preheating one said combustion mediums, after the passage thereof through the respective said heat exchanger, by an externally fired recuperator;

feeding flue gases from said externally fired recuperator to said waste gases before preheating of said one combustion medium by said waste gases; and controlling the external firing of said recuperator as a function of the final preheated temperature of the thus twice preheated said one combustion medium.

2. A process as claimed in claim 1, wherein said one combustion medium comprises said combustion air.

3. A process as claimed in claim 2, wherein said waste gases first preheat said combustion air, then preheat said fuel gas and then pass to a stack.

4. A process as claimed in claim 3, further comprising controlling the temperature in said recuperator by supplying thereto said waste gases from a position downstream of said heat exchanger for preheating said fuel gas in response to a detection of said temperature in said recuperator.

5. A process as claimed in claim 3, further comprising controlling the temperature of said waste gases entering said stack by returning waste gases from a position between said heat exchangers to the entrance of said heat exchanger for preheating said combustion air in response to a detection of said temperature of said waste gases at the entrance of said stack.

6. A process as claimed in claim 3, further comprising controlling the preheating temperature of said fuel gas by returning waste gases from a position between said heat exchangers to the entrance of said heat exchanger for preheating said combustion air in response to a detection of the temperature of said preheated fuel gas.

7. A process as claimed in claim 3, further comprising controlling the temperature of said waste gases entering said stack by supplying waste gases from a position between said heat exchangers to said recuperator in response to a detection of said temperature of said waste gases at the entrance of said stack.

8. A process as claimed in claim 3, further comprising controlling the preheating temperature of said fuel gas by supplying waste gases from a position between said heat exchangers to said recuperator in response to a detection of the temperature of said preheated fuel gas.

9. A process as claimed in claim 3, further comprising apportioning the relative quantities of said combustion air preheated by said respective heat exchanger and/or by said recuperator as a function of the temperature of said waste gases at the entrance of said stack.

10. An apparatus for preheating the combustion mediums of combustion air and fuel gas used for firing blast furnace stoves by utilizing the heat of waste gases resulting from such firing, said apparatus comprising:

a waste gas main for conveying waste gases resulting from firing blast furnace stoves;

first and second heat exchangers arranged serially along said waste gas main for passing combustion mediums in heat exchange relationship with said waste gases, and thereby preheating the combustion mediums;

an externally fired recuperator;

means for passing one said combustion medium, after the passage thereof through the respective said heat exchanger, in heat exchange relationship with flue gases of said recuperator, thereby further preheating said one combustion medium;

means for feeding said flue gases of said recuperator, after said further preheating of said one combustion medium thereby, to said waste gas main at a position upstream of said heat exchanger for said one combustion medium; and first temperature sensor control means for detecting the final preheated temperature of the thus twice preheated said one combustion medium and controlling the external firing of said recuperator as a function of said detected temperature.

11. An apparatus as claimed in claim 10, wherein said first and second heat exchangers preheat combustion air and fuel gas, respectively, said one combustion medium comprises said combustion air, and further comprising a stack connected to said waste gas main downstream of said second heat exchanger.

12. An apparatus as claimed in claim 11, further comprising second temperature sensor control means for detecting the temperature of said flue gases entering said recuperator, and return circuit means, controllable by said second temperature sensor control means, for supplying to said recuperator waste gases from said waste gas main at a position downstream of said second heat exchanger, and thereby for controlling the temperature in said recuperator.

13. An apparatus as claimed in claim 12, wherein said return circuit means comprises a mixing chamber receiving said flue gases from the external firing, a branch line extending from said position at said waste gas main to said mixing chamber, and a blower operable by said second temperature sensor control means for withdrawing waste gases from said waste gas main through said branch line to said mixing chamber.

14. An apparatus as claimed in claim 13, further comprising a return circuit pipe extending from said waste gas main at a position between said first and second heat exchangers to said branch line, a first throttle valve in said return circuit pipe, a second throttle valve in said branch line, third temperature sensor control means for detecting the temperature of said waste gases at the entrance to said stack and for operating said first and second throttle valves, thereby for controlling the temperature of said waste gases at said entrance to said stack, and fourth temperature sensor control means for detecting the temperature of said preheated fuel gas and for operating said first and second throttle valves, thereby for controlling the temperature of said preheated fuel gas.

15. An apparatus as claimed in claim 11, further comprising third temperature sensor control means for detecting the temperature of said waste gases at the entrance to said stack, and return circuit means, controllable by said third temperature sensor control means, for returning waste gases from said waste gas main at a position between said first and second heat exchangers to said waste gas main at a position upstream of said first heat exchanger, and thereby for controlling the temperature of said waste gases at said entrance to said stack.

16. An apparatus as claimed in claim 11, further comprising fourth temperature sensor control means for detecting the temperature of said preheated fuel gas, and return circuit means, controllable by said third temperature sensor control means, for returning waste gases from said waste gas main at a position between said first and second heat exchangers to said waste gas main at a position upstream of said first heat exchanger, and thereby for controlling the temperature of said preheated fuel gas.

17. An apparatus as claimed in claim 11, further comprising third temperature sensor control means for detecting the temperature of said waste gases at the entrance to said stack, and apportioning means, controllable by said third temperature sensor control means, for apportioning the relative quantities of said combustion air preheated by said respective heat exchanger and/or by said recuperator, and thereby regulating said temperature of said waste gases at said entrance to said stack.

* * * * *